US009383671B2

(12) United States Patent
Tajima

(10) Patent No.: US 9,383,671 B2
(45) Date of Patent: Jul. 5, 2016

(54) TONER

(71) Applicant: Kao Corporation, Chuo-ku (JP)

(72) Inventor: Hisakazu Tajima, Wakayama (JP)

(73) Assignee: Kao Corporation, Chuo-ku (JP)

( * ) Notice: Subject to any disclaimer, the term of this patent is extended or adjusted under 35 U.S.C. 154(b) by 7 days.

(21) Appl. No.: 14/444,402

(22) Filed: Jul. 28, 2014

(65) Prior Publication Data

US 2015/0072284 A1 Mar. 12, 2015

(30) Foreign Application Priority Data

Sep. 6, 2013 (JP) ..... 2013-185190

(51) Int. Cl.

*G03G 9/08* (2006.01)
*G03G 9/097* (2006.01)
*G03G 9/087* (2006.01)

(52) U.S. Cl.

CPC ..... *G03G 9/09758* (2013.01); *G03G 9/08704* (2013.01); *G03G 9/08755* (2013.01); *G03G 9/08782* (2013.01); *G03G 9/09733* (2013.01); *G03G 9/09741* (2013.01); *G03G 9/09775* (2013.01)

(58) Field of Classification Search

CPC ..... G03G 9/08755; G03G 9/09733
USPC ..... 430/109.4, 108.1
See application file for complete search history.

(56) References Cited

U.S. PATENT DOCUMENTS

2010/0136469 A1 6/2010 Tajima et al.
2011/0300477 A1* 12/2011 Yoshida et al. ..... 430/105

FOREIGN PATENT DOCUMENTS

JP 09-146300 A 6/1997
JP 2000-352838 A 12/2000
JP 2006-154624 A 6/2006
JP 2010-156952 A 7/2010
JP 2011-123423 A 6/2011
JP 2013-033176 A 2/2013
JP 2013-092626 A 5/2013

OTHER PUBLICATIONS

Extended European Search Report issued Jan. 20, 2015, in Patent Application No. 14183447.3.

* cited by examiner

*Primary Examiner* — Mark A Chapman
(74) *Attorney, Agent, or Firm* — Oblon, McClelland, Maier & Neustadt, L.L.P.

(57) ABSTRACT

A toner containing a resin binder, a releasing agent, and a charge control agent, wherein the resin binder contains a polyester (A) obtained by polycondensing a carboxylic acid component containing one or more succinic acid derivatives selected from succinic acids substituted with an alkyl group having 8 or more carbon atoms and 20 or less carbon atoms and succinic acids substituted with an alkenyl group having 8 or more carbon atoms and 20 or less carbon atoms, and an alcohol component, a content of the succinic acid derivative being 10% by mol or more and 30% by mol or less of a total amount of the raw material monomers of all the polyesters in the resin binder, and wherein the releasing agent contains an α-olefin based polymer obtained by polymerizing monomers containing an α-olefin having 26 or more carbon atoms and 28 or less carbon atoms in an amount of 95% by mol or more, a content of the α-olefin based polymer being 0.5 parts by mass or more and 10 parts by mass or less, based on 100 parts by mass of the resin binder. The toner of the present invention is usable in developing latent images formed in, for example, an electrophotographic method, an electrostatic recording method, an electrostatic printing method, or the like.

20 Claims, No Drawings

TONER

FIELD OF THE INVENTION

The present invention relates to a toner usable in developing latent images formed in, for example, an electrophotographic method, an electrostatic recording method, an electrostatic printing method, or the like.

BACKGROUND OF THE INVENTION

In the recent years, in addition to the acceleration of miniaturization, speed-up, and high-quality image formation of electrophotographic apparatuses, the needs for conservation of resources and conservation of energy are being strongly in demand.

In order to meet the requirements, for example, Japanese Patent Laid-Open No. 2013-92626 discloses a method for producing a toner including the step of melt-kneading at least a resin binder and a releasing agent, wherein the releasing agent contains an α-olefin based polymer obtained by polymerizing monomers containing a specified amount of an α-olefin having a specified number of carbon atoms, and wherein the melt-kneading is carried out with an open roller type kneader, whereby a toner capable of reducing the amount of toner remaining in a toner cartridge is obtained.

Japanese Patent Laid-Open No. 2000-352838 discloses that in a color toner composed of matrix colored particles containing at least a resin binder, a colorant, a releasing agent, and a charge control agent as main components, and an external additive, the color toner for electrophotography characterized in that as a releasing agent a 1-olefin polymer wax composed of units derived from a 1-olefin represented by $R'CH{=}CH_2$, wherein R' is an alkyl having 1 to 28 carbon atoms, having specified physical property values, is used, whereby a toner has excellent and stable developability and has excellent fusing ability, gloss, transparency, and releasing property without applying fusing oil to a fusing apparatus even under stirring for a long period of time.

In addition, Japanese Patent Laid-Open No. 2013-33176 discloses a positively chargeable toner containing a resin binder containing a polyester resin, a colorant, and a positively chargeable charge control agent, wherein the resin binder contains a specified amount of a titanium compound, whereby the positively chargeable toner has high initial triboelectric charges, and controlled initial background fogging and development ghosts.

SUMMARY OF THE INVENTION

The present invention relates to a toner containing a resin binder, a releasing agent, and a charge control agent, wherein the resin binder contains a polyester (A) obtained by polycondensing a carboxylic acid component containing one or more succinic acid derivatives selected from succinic acids substituted with an alkyl group having 8 or more carbon atoms and 20 or less carbon atoms and succinic acids substituted with an alkenyl group having 8 or more carbon atoms and 20 or less carbon atoms, and an alcohol component, a content of the succinic acid derivative being 10% by mol or more and 30% by mol or less of a total amount of the raw material monomers of all the polyesters in the resin binder, and wherein the releasing agent contains an α-olefin based polymer obtained by polymerizing monomers containing an α-olefin having 26 or more carbon atoms and 28 or less carbon atoms in an amount of 95% by mol or more, a content of the α-olefin based polymer being from 0.5 parts by mass or more and 10 parts by mass or less, based on 100 parts by mass of the resin binder.

DETAILED DESCRIPTION OF THE INVENTION

In the electrophotographic process, a system including a contact charging step with a roller charging or brush charging without providing a cleaning step is a main trend, from the viewpoint of eco-friendly awareness and lowering costs of the printers and the like, and in the charging step as described above, charging members such as rollers and brushes are strongly pressed against a photoconductor, toner stains are more likely to be caused on the surfaces of charging members and photoconductors especially under low-temperature, low-humidity environments, so that there is a disadvantage of making it more likely to worsen image quality by the lowering of surface potentials of the photoconductor.

The present invention relates to a toner having excellent inhibition of photoconductor filming. Further, the present invention relates to a toner having excellent triboelectric stability, and being inhibitory in the generation of background fogging or the lowering of solid image quality.

The toner of the present invention exhibits excellent effects of inhibiting photoconductor filming. In addition, the toner of the present invention further exhibits some excellent effects such as excellent triboelectric stability, and being inhibitory in the generation of background fogging and the lowering of solid image quality.

The toner of the present invention contains a resin binder containing a polyester (A) obtained by polycondensing a carboxylic acid component containing one or more succinic acid derivatives selected from succinic acids substituted with an alkyl group having 8 or more carbon atoms and 20 or less carbon atoms and succinic acids substituted with an alkenyl group having 8 or more carbon atoms and 20 or less carbon atoms, and an alcohol component, and a releasing agent containing an α-olefin based polymer obtained by polymerizing monomers containing an α-olefin having 26 or more carbon atoms and 28 or less carbon atoms, whereby a toner can inhibit photoconductor filming. Further, the toner of the present invention has excellent triboelectric stability, thereby inhibiting the generation of background fogging and the lowering of solid image quality of the toner.

The reasons why the effects as mentioned above are exhibited are not certain, but they are presumably as follows.

In the present invention, the α-olefin based polymer usable in the releasing agent does not have a polar group and has a high crystallinity in a side chain, so that the α-olefin based polymer has high hardness while having a low melting point as compared to other releasing agents, so that the α-olefin based polymer is less likely to be dispersed in a resin binder containing the polyester. On the other hand, in the present invention, since a polyester contains a carboxylic acid component containing the above-mentioned succinic acid derivative, the α-olefin based polymer is more easily dispersed in the toner particles having a similar side chain portion owing to a side chain portion of the hydrocarbon owned by the polyester, and crystallinity of the α-olefin based polymer owned by the same side chain portion is maintained. As a result, the α-olefin based polymer acts as so-called a linking role between resin binders, so that it is considered that the toner is made tougher, and that filming on a photoconductor is inhibited.

In addition, since the α-olefin based polymer has a structure of a highly even side chain length, obtained by polymerizing monomers containing an α-olefin having 26 or more carbon atoms and 28 or less carbon atoms in an amount of 95% by mol or more, share is evenly applied between resins during melt-kneading so as to evenly keep the viscosity, and a charge control agent disperses in the toner homogeneously. As a result, the variances in triboelectric properties between toner particles are reduced, so that the triboelectric charges of the toner particles are improved, and at the same time a toner has excellent inhibition in the generation of background fogging and excellent solid image quality.

[Resin Binder]

The resin binder usable in the present invention contains a polyester (A) obtained by polycondensing a carboxylic acid component containing one or more succinic acid derivatives selected from succinic acids substituted with an alkyl group having 8 or more carbon atoms and 20 or less carbon atoms and succinic acids substituted with an alkenyl group having 8 or more carbon atoms and 20 or less carbon atoms, and an alcohol component.

Specific examples of the succinic acids substituted with an alkyl group having 8 or more carbon atoms and 20 or less carbon atoms and the succinic acids substituted with an alkenyl group having 8 or more carbon atoms and 20 or less carbon atoms include dodecylsuccinic acid, dodecenylsuccinic acid, tetrapropenylsuccinic acid, decenylsuccinic acid, acid anhydrides thereof, alkyl esters thereof of which alkyl moiety has 1 or more carbon atoms and 3 or less carbon atoms. Among them, dodecenylsuccinic acid and tetrapropenylsuccinic acid, and acid anhydrides thereof are preferred, and tetrapropenylsuccinic anhydride is more preferred, from the viewpoint of inhibiting photoconductor filming of the toner.

The number of carbon atoms of the alkyl group or alkenyl group in the succinic acid derivative is 8 or more, preferably 10 or more, and more preferably 12 or more, and the number of carbon atoms is 20 or less, preferably 18 or less, and more preferably 16 or less, from the viewpoint of inhibiting photoconductor filming of the toner.

Therefore, the succinic acid derivative is preferably one or more members selected from the group consisting of succinic acids substituted with an alkyl group having 10 or more carbon atoms and 20 or less carbon atoms and the succinic acids substituted with an alkenyl group having 10 or more carbon atoms and 20 or less carbon atoms, and more preferably one or more members selected from the group consisting of succinic acids substituted with an alkyl group having 12 or more carbon atoms and 16 or less carbon atoms and the succinic acids substituted with an alkenyl group having 12 or more carbon atoms and 16 or less carbon atoms, from the viewpoint of inhibiting photoconductor filming of the toner, and from the viewpoint of improving triboelectric stability, thereby inhibiting the generation of background fogging or the lowering of solid image quality of the toner.

The content of the succinic acid derivative is preferably 3% by mol or more, more preferably 10% by mol or more, even more preferably 15% by mol or more, and even more preferably 20% by mol or more, of the carboxylic acid component of the polyester (A), from the viewpoint of inhibiting photoconductor filming of the toner, and from the viewpoint of improving triboelectric stability, thereby inhibiting the generation of background fogging or the lowering of solid image quality of the toner. In addition, the content of the succinic acid derivative is preferably 90% by mol or less, more preferably 88% by mol or less, even more preferably 86% by mol or less, and even more preferably 85% by mol or less of the carboxylic acid component of the polyester (A), from the viewpoint of improving heat-resistant storage property of the toner.

Here, the content of the succinic acid derivative in a case where the resin binder contains a plural polyester (A)s can be obtained as the sum of the contents of the succinic acid derivative which is one or more members selected from the group consisting of succinic acids substituted with an alkyl group having 8 or more carbon atoms and 20 or less carbon atoms and the succinic acids substituted with an alkenyl group having 8 or more carbon atoms and 20 or less carbon atoms in the carboxylic acid component of each of the polyester (A)s multiplied by the mass percentages of each of the polyester (A)s.

The dicarboxylic acid compound other than the succinic acid derivative includes, for example, dicarboxylic acids preferably having 3 or more carbon atoms and 30 or less carbon atoms, more preferably having 3 or more carbon atoms and 20 or less carbon atoms, and even more preferably having 3 or more carbon atoms and 10 or less carbon atoms; derivatives such as acid anhydrides thereof, and alkyl esters of which alkyl moiety has 1 or more carbon atoms and 3 or less carbon atoms, and the like. Specifically, aromatic dicarboxylic acid compounds and aliphatic dicarboxylic acid compounds are preferred, and the aromatic dicarboxylic acid compounds are more preferred, from the viewpoint of improving triboelectric stability, thereby inhibiting the generation of background fogging and the lowering of solid image quality of the toner. The aromatic dicarboxylic acid includes phthalic acid, isophthalic acid, terephthalic acid, and the like, and among them, terephthalic acid is preferred. The aliphatic dicarboxylic acid includes fumaric acid, maleic acid, succinic acid, glutaric acid, adipic acid, sebacic acid, and the like.

The tricarboxylic or higher polycarboxylic acid compound includes, for example, tricarboxylic or higher polycarboxylic acids having preferably 4 or more carbon atoms and 30 or less carbon atoms, more preferably 4 or more carbon atoms and 20 or less carbon atoms, and even more preferably 4 or more carbon atoms and 10 or less carbon atoms; derivatives such as acid anhydrides thereof, and alkyl esters of which alkyl moiety has 1 or more carbon atoms and 3 or less carbon atoms, and the like. Specific examples include 1,2,4-benzenetricarboxylic acid (trimellitic acid), 2,5,7-naphthalenetricarboxylic acid, 1,2,4,5-benzenetetracarboxylic acid (pyromellitic acid), and the like, and 1,2,4-benzenetricarboxylic acid (trimellitic acid) and an acid anhydride thereof are preferred, and 1,2,4-benzenetricarboxylic acid anhydride (trimellitic anhydride) is more preferred, from the viewpoint of inhibiting photoconductor filming of the toner, and from the viewpoint of improving triboelectric stability, thereby inhibiting the generation of background fogging and the lowering of solid image quality of the toner.

In the alcohol component, the dihydric alcohol includes diols having preferably 2 or more carbon atoms and 20 or less carbon atoms, and more preferably 2 or more carbon atoms and 15 or less carbon atoms; and alkylene oxide adducts of bisphenol A represented by the formula (I):

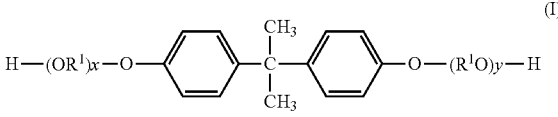

wherein $R^1O$ and $OR^1$ are an oxyalkylene group, wherein $R^1$ is an ethylene and/or propylene group, x and y each shows an average number of moles of the alkylene oxide added, each being a positive number, and the sum of x and y on average is preferably 1 or more and 16 or less, more preferably 1 or more and 8 or less, and even more preferably 1.5 or more and 4 or less.

Specific examples of the dihydric alcohol having 2 or more carbon atoms and 20 or less carbon atoms include ethylene glycol, propylene glycol, 1,4-butanediol, 1,6-hexanediol, bisphenol A, hydrogenated bisphenol A, and the like.

The alcohol component is preferably an alkylene oxide adduct of bisphenol A represented by the formula (I), from the viewpoint of improving triboelectric stability, thereby inhibiting the generation of background fogging and the lowering of solid image quality of the toner. The content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

The trihydric or higher polyhydric alcohol includes, for example, trihydric or higher polyhydric alcohols having preferably 3 or more carbon atoms and 20 or less carbon atoms, and more preferably 3 or more carbon atoms and 10 or less carbon atoms. Specific examples include sorbitol, 1,4-sorbitan, pentaerythritol, glycerol, trimethylolpropane, and the like.

Here, the alcohol component may properly contain a monohydric alcohol, and the carboxylic acid component may properly contain a monocarboxylic acid compound, from the viewpoint of adjusting the softening point of the polyester.

An equivalent ratio, i.e. COOH group or groups/OH group or groups, of the carboxylic acid component and the alcohol component in the polyester (A) is preferably 0.70 or more, and more preferably 0.75 or more, and the equivalent ratio is preferably 1.15 or less, and more preferably 1.10 or less, from the viewpoint of reducing an acid value of the polyester.

The polyester can be produced by polycondensing the alcohol component and the carboxylic acid component in an inert gas atmosphere at a temperature of about 180° C. or higher and about 250° C. or lower, optionally in the presence of an esterification catalyst, an esterification promoter, a polymerization inhibitor or the like. The esterification catalyst includes tin compounds such as dibutyltin oxide and tin(II) 2-ethylhexanoate, titanium compounds such as titanium diisopropylate bistriethanolaminate; and the like. The esterification promoter includes gallic acid, and the like. The esterification catalyst is used in an amount of preferably 0.01 parts by mass or more, and more preferably 0.1 parts by mass or more, based on 100 parts by mass of a total amount of the alcohol component and the carboxylic acid component, and the esterification catalyst is used in an amount of preferably 1.5 parts by mass or less, and more preferably 1.0 part by mass or less, based on 100 parts by mass of a total amount of the alcohol component and the carboxylic acid component. The esterification promoter is used in an amount of preferably 0.001 parts by mass or more, and more preferably 0.01 parts by mass or more, based on 100 parts by mass of a total amount of the alcohol component and the carboxylic acid component, and the esterification promoter is used in an amount of preferably 0.5 parts by mass or less, and more preferably 0.1 parts by mass or less, based on 100 parts by mass of a total amount of the alcohol component and the carboxylic acid component.

The softening point of the polyester (A) is preferably 80° C. or higher, more preferably 100° C. or higher, even more preferably 110° C. or higher, and even more preferably 120° C. or higher, from the viewpoint of improving high-temperature offset resistance of the toner. Also, the softening point is preferably 170° C. or lower, more preferably 165° C. or lower, even more preferably 160° C. or lower, and even more preferably 158° C. or lower, from the viewpoint of improving low-temperature fusing ability of the toner, from the viewpoint of improving dispersibility of the charge control agent in the resin binder, thereby inhibiting photoconductor filming of the toner, and from the viewpoint of improving triboelectric stability, thereby inhibiting the generation of background fogging and the lowering of solid image quality of the toner.

The softening point of the polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

The glass transition temperature of the polyester (A) is preferably 30° C. or higher, more preferably 35° C. or higher, and even more preferably 38° C. or higher, from the viewpoint of improving heat-resistant storage property and high-temperature offset resistance of the toner. Moreover, the glass transition temperature is preferably 90° C. or lower, more preferably 80° C. or lower, even more preferably 70° C. or lower, and even more preferably 65° C. or lower, from the viewpoint of improving low-temperature fusing ability of the toner. Here, the glass transition temperature is a physical property intrinsically owned by an amorphous resin.

The glass transition temperature of the polyester (A) can be controlled by the kinds, compositional ratios and the like of the alcohol component or the carboxylic acid component.

The acid value of the polyester (A) is preferably 20 mgKOH/g or less, more preferably 15 mgKOH/g or less, and even more preferably 10 mgKOH/g or less, from the viewpoint of improving triboelectric stability, thereby inhibiting the generation of background fogging and the lowering of solid image quality of the toner.

The acid value of the polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

The hydroxyl value of the polyester (A) is preferably 60 mgKOH/g or less, more preferably 50 mgKOH/g or less, and even more preferably 30 mgKOH/g or less, from the viewpoint of improving triboelectric stability, thereby inhibiting the generation of background fogging and the lowering of solid image quality of the toner.

The hydroxyl value of the polyester (A) can be controlled by adjusting the kinds and compositional ratios of the alcohol component and the carboxylic acid component, an amount of a catalyst, or the like, or selecting reaction conditions such as reaction temperature, reaction time and reaction pressure.

It is preferable that the toner of the present invention contains two kinds of polyester (A)s having different softening points, from the viewpoint of inhibiting photoconductor filming of the toner, from the viewpoint of improving triboelectric stability, thereby inhibiting the generation of background fogging and the lowering of solid image quality of the toner, and from the viewpoint of improving low-temperature fusing ability and high-temperature offset resistance of the toner.

In the production of the toner, by controlling the softening points of the two kinds of the polyester (A)s within a certain range, an appropriate share can be applied during melt-kneading of the raw materials, so that the dispersibility of a releasing agent and a charge control agent can be excellently maintained, whereby consequently the photoconductor filming of the toner can be inhibited, and triboelectric stability is improved, thereby inhibiting the generation of background fogging and the lowering of the solid image quality of the toner.

From the above viewpoint, of the two kinds of the polyester (A)s having different softening points mentioned above, when a polyester (A) having a higher softening point is referred to as a polyester (A-H), and a polyester (A) having a lower softening point is referred to as a polyester (A-L), a difference in softening points between the polyester (A-H) and the polyester (A-L) is preferably 10° C. or more, more preferably 15° C. or more, and even more preferably 20° C. or more, from the viewpoint of improving low-temperature fusing ability and high-temperature offset resistance of the toner. In addition, the difference in softening points is preferably 65° C. or less, more preferably 50° C. or less, and even more preferably 40° C. or less, from the viewpoint of improving dispersibility of the releasing agent and the charge control agent in the resin binder, thereby inhibiting photoconductor filming of the toner, and from the viewpoint of improving triboelectric stability, thereby inhibiting the generation of background fogging and the lowering of solid image quality of the toner.

The softening point of the polyester (A-H) is preferably 140° C. or higher, more preferably 145° C. or higher, and even more preferably 150° C. or higher, from the viewpoint of improving high-temperature offset resistance of the toner. In addition, the softening point is preferably 170° C. or lower, more preferably 165° C. or lower, and even more preferably 160° C. or lower, from the viewpoint of improving low-temperature fusing ability of the toner, from the viewpoint of improving dispersibility of the charge control agent in the resin binder, thereby inhibiting photoconductor filming of the toner, and from the viewpoint of improving triboelectric stability, thereby inhibiting the generation of background fogging and the lowering of solid image quality of the toner.

On the other hand, the softening point of the polyester (A-L) is preferably 105° C. or higher, more preferably 110° C. or higher, and even more preferably 115° C. or higher, from the viewpoint of improving high-temperature offset resistance of the toner, from the viewpoint of improving dispersibility of the charge control agent in the resin binder, thereby inhibiting photoconductor filming of the toner, and from the viewpoint of improving triboelectric stability, thereby inhibiting the generation of background fogging and the lowering of solid image quality of the toner. In addition, the softening point is preferably 140° C. or lower, more preferably 130° C. or lower, and even more preferably 125° C. or lower, from the viewpoint of improving low-temperature fusing ability of the toner.

Further, it is preferable that the polyester (A-H) and the polyester (A-L) have different glass transition temperatures. The glass transition temperature of the polyester (A-H) is preferably exceeding 55° C., more preferably 57° C. or higher, and even more preferably 60° C. or higher, from the viewpoint of improving storage stability and high-temperature offset resistance of the toner. In addition, the glass transition temperature is preferably 75° C. or lower, more preferably 70° C. or lower, and even more preferably 65° C. or lower, from the viewpoint of improving low-temperature fusing ability of the toner.

The glass transition temperature of the polyester (A-L) is preferably lower than a glass transition temperature of the polyester (A-H), and a difference in the glass transition temperatures between the polyester (A-H) and the polyester (A-L) is preferably 5° C. or more, more preferably 7° C. or more, and even more preferably 9° C. or more, from the viewpoint of improving low-temperature fusing ability of the toner. In addition, the difference in the glass transition temperatures is preferably 40° C. or less, more preferably 30° C. or less, and even more preferably 25° C. or less, from the viewpoint of improving dispersibility of a positively chargeable charge control agent in the resin binder, and improving triboelectric stability, thereby inhibiting the generation of background fogging and the lowering of solid image quality of the toner.

The content of the succinic acid derivative in the polyester (A-H) is preferably 5% by mol or more, more preferably 15% by mol or more, and even more preferably 20% by mol or more, of the carboxylic acid component of the polyester (A-H), from the viewpoint of inhibiting photoconductor filming of the toner, and from the viewpoint of improving triboelectric stability, thereby inhibiting the generation of background fogging and the lowering of solid image quality of the toner. In addition, the content is preferably 35% by mol or less, more preferably 30% by mol or less, and even more preferably 27% by mol or less, of the carboxylic acid component of the polyester (A-H), from the viewpoint of improving storage stability and high-temperature offset resistance of the toner.

In addition, the content of the succinic acid derivative in the polyester (A-H) is preferably 2% by mol or more, more preferably 5% by mol or more, and even more preferably 7% by mol or more, of a total amount of the raw material monomers of the polyester (A-H), in other words, a total amount of the carboxylic acid component and the alcohol component, from the viewpoint of inhibiting photoconductor filming of the toner, and from the viewpoint of improving triboelectric stability, thereby inhibiting the generation of background fogging and the lowering of solid image quality of the toner. In addition, the content is preferably 20% by mol or less, more preferably 17% by mol or less, and even more preferably 14% by mol or less, of a total amount of the carboxylic acid component and the alcohol component, from the viewpoint of improving storage stability and high-temperature offset resistance of the toner.

The content of the succinic acid derivative in the polyester (A-L) is preferably 15% by mol or more, more preferably 25% by mol or more, and even more preferably 30% by mol or more, of the carboxylic acid component of the polyester (A-L), from the viewpoint of lowering the glass transition temperature of the polyester (A-L), and improving low-temperature fusing ability of the toner, from the viewpoint of inhibiting photoconductor filming of the toner, and from the viewpoint of improving triboelectric stability, thereby inhibiting the generation of background fogging and the lowering of solid image quality of the toner. In addition, the content is preferably 95% by mol or less, more preferably 90% by mol or less, and even more preferably 85% by mol or less, of the carboxylic acid component of the polyester (A-L), from the viewpoint of improving storage stability and high-temperature offset resistance of the toner.

In addition, the content of the succinic acid derivative in the polyester (A-L) is preferably 5% by mol or more, more preferably 10% by mol or more, and even more preferably 15% by mol or more, of a total amount of the raw material monomers of the polyester (A-L), in other words, a total amount of the carboxylic acid component and the alcohol component, from the viewpoint of lowering the glass transition temperature of the polyester (A-L), and improving low-temperature fusing ability and high-temperature offset resistance of the toner, from the viewpoint of inhibiting photoconductor filming of the toner, and from the viewpoint of improving triboelectric stability, thereby inhibiting the generation of background fogging and the lowering of solid image quality of the toner. In addition, the content is preferably 50% by mol or less, more preferably 45% by mol or less, and even more preferably 40% by mol or less, of a total amount of the carboxylic acid component and the alcohol component, from the viewpoint of improving storage stability and high-temperature offset resistance of the toner.

A mass ratio of the polyester (A-H) to the polyester (A-L) in the resin binder, i.e. the polyester (A-H)/the polyester (A-L), is preferably 10/90 or more and 90/10 or less, more preferably 20/80 or more and 80/20 or less, even more preferably 30/70 or more and 70/30 or less, and even more preferably 60/40 or more and 40/60 or less, from the viewpoint of improving low-temperature fusing ability and high-temperature offset resistance of the toner, from the viewpoint of inhibiting photoconductor filming of the toner, and from the viewpoint of improving triboelectric stability, thereby inhibiting the generation of background fogging and the lowering of solid image quality of the toner.

The polyester (A) may contain a polyester resin other than the polyester (A-H) and the polyester (A-L) within a range that would not hamper the effects of the present invention, and a total amount of the polyester (A-H) and the polyester (A-L) is preferably 80% by mass or more, more preferably 90% by mass or more, even more preferably substantially 100% by mass, and even more preferably 100% by mass, of the polyester resin.

Here, in the present invention, the polyester (A) may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

The content of the polyester (A) is preferably 60% by mass or more, more preferably 70% by mass or more, even more preferably 80% by mass or more, even more preferably 90% by mass or more, and even more preferably 95% by mass or more, of the resin binder, from the viewpoint of inhibiting photoconductor filming of the toner, and from the viewpoint of improving triboelectric stability, thereby inhibiting the generation of background fogging and the lowering of solid image quality of the toner. It is even more preferable to use the polyester (A) alone as the resin binder, and a resin other than the polyester (A) may be contained within a range that would not hamper the effects on photoconductor filming, triboelectric stability, background fogging, solid image quality of the toner. Other resin binders include other polyesters, vinyl resins, epoxy resins, polycarbonates, polyurethanes, and the like.

The content of the succinic acid derivative in all the polyesters in the resin binder, i.e. the polyester (A) and the polyesters other than the polyester (A), is 10% by mol or more, preferably 12% by mol or more, more preferably 13% by mol or more, and even more preferably 14% by mol or more, of a total amount of the raw material monomers in each of the polyesters, in other words, a total amount of the carboxylic acid component and the alcohol component, from the viewpoint of inhibiting photoconductor filming of the toner, and from the viewpoint of improving triboelectric stability, thereby inhibiting the generation of background fogging and the lowering of solid image quality of the toner. In addition, the content is 30% by mol or less, preferably 28% by mol or less, and more preferably 25% by mol or less, from the viewpoint of improving heat-resistant storage property of the toner.

[Releasing Agent]

The releasing agent in the present invention contains an α-olefin based polymer obtained by polymerizing monomers containing a specified amount of an α-olefin having 26 or more carbon atoms and 28 or less carbon atoms.

The content of the α-olefin having 26 or more carbon atoms and 28 or less carbon atoms in the raw material monomers of the α-olefin based polymer is 95% by mol or more, and preferably 97% by mol or more, from the viewpoint of inhibiting photoconductor filming of the toner, and from the viewpoint of improving triboelectric stability, thereby inhibiting the generation of background fogging and the lowering of solid image quality of the toner.

The monomers containing an α-olefin having 26 or more carbon atoms and 28 or less carbon atoms in an amount of 95% by mol or more include a blend of α-olefins having 18 or more carbon atoms; for example, monomers obtained by distilling "LINEALENE 26+," (Idemitsu Kosan Co., Ltd., a blend of α-olefins mainly composed of those having 26 or more carbon atoms), or dissolving "LINEALENE 26+" in a hydrocarbon solvent at a temperature of 50° C. or lower, and preferably from 15° to 50° C., and extracting a homogeneous supernatant solution, can be used.

As the above-mentioned hydrocarbon solvent, for example, an aromatic hydrocarbon solvent such as toluene or xylene; an alicyclic hydrocarbon solvent such as cyclopentane or cyclohexane; an aliphatic hydrocarbon solvent such as pentane or hexane; a halogenated hydrocarbon solvent such as chloroform or dichloromethane can be used. These solvents can be used alone or in a mixture of two or more kinds.

From the viewpoint of inhibiting photoconductor filming of the toner, and from the viewpoint of improving triboelectric stability, thereby inhibiting the generation of background fogging and the lowering of solid image quality of the toner, the melting point of the α-olefin based polymer in the present invention is preferably 60° C. or higher, more preferably 64° C. or higher, even more preferably 68° C. or higher, and even more preferably 72° C. or higher, and the melting point is preferably 90° C. or lower, more preferably 85° C. or lower, and even more preferably 80° C. or lower. The melting point of the α-olefin based polymer can be obtained in accordance with a method described in Examples set forth below.

From the viewpoint of inhibiting photoconductor filming of the toner, and from the viewpoint of improving triboelectric stability, thereby inhibiting the generation of background fogging and the lowering of solid image quality of the toner, the melt viscosity at 100° C. of the α-olefin based polymer is preferably 100 mPa·s or more, more preferably 120 mPa·s or more, even more preferably 150 mPa·s or more, even more preferably 180 mPa·s or more, and even more preferably 190 mPa·s or more, and the melt viscosity is preferably 300 mPa·s or less, more preferably 250 mPa·s or less, and even more preferably 220 mPa·s or less.

The α-olefin based polymer can be synthesized in accordance with a method described in WO 2007/063885. Specifically, the α-olefin based polymer is obtained by dissolving an α-olefin monomer in an aromatic hydrocarbon solvent such as toluene, and adding a methallocene catalyst and hydrogen thereto to polymerize under the conditions of a temperature of from 0° to 180° C. and normal pressure to 10 MPa.

The content of the α-olefin based polymer in the toner is 0.5 parts by mass or more, preferably 1 part by mass or more, more preferably 1.5 parts by mass or more, and even more preferably 2 parts by mass or more, based on 100 parts by mass of the resin binder, from the viewpoint of inhibiting photoconductor filming of the toner, from the viewpoint of improving triboelectric stability, thereby inhibiting the generation of background fogging and the lowering of solid image quality of the toner, and from the viewpoint of improving low-temperature fusing ability. In addition, the content is 10 parts by mass or less, preferably 8 parts by mass or less, more preferably 6 parts by mass or less, even more preferably 5 parts by mass or less, and even more preferably 4 parts by mass or less, based on 100 parts by mass of the resin binder, from the viewpoint of inhibiting photoconductor filming of the toner, from the viewpoint of improving triboelectric stability, thereby inhibiting the generation of background fogging and the lowering of solid image quality of the toner, and from the viewpoint of improving storage stability.

In addition, the releasing agent used in the present invention may contain a releasing agent other than the α-olefin based polymer within a range that would not hamper the effects of the present invention.

The releasing agent other than the α-olefin based polymer is preferably a wax having a melting point different from the melting point of the above-mentioned α-olefin based polymer, from the viewpoint of inhibiting photoconductor filming of the toner, from the viewpoint of improving triboelectric stability, thereby inhibiting the generation of background fogging and the lowering of solid image quality of the toner, and from the viewpoint of improving releasing property. A difference between the melting point of the wax and the melting point of the α-olefin based polymer is preferably 50° C. or more, more preferably 65° C. or more, and the difference is preferably 90° C. or less, and more preferably 75° C. or less.

The melting point of the above-mentioned wax is preferably 120° C. or higher, more preferably 130° C. or higher, and even more preferably 135° C. or higher, from the viewpoint of inhibiting photoconductor filming of the toner, from the viewpoint of improving triboelectric stability, thereby inhibiting the generation of background fogging and the lowering of solid image quality of the toner, from the viewpoint of improving high-temperature offset resistance. The melting point of the wax is preferably 160° C. or lower, and more preferably 150° C. or lower, from the viewpoint of inhibiting photoconductor filming of the toner, from the viewpoint of improving triboelectric stability, thereby inhibiting the generation of background fogging and the lowering of solid image quality of the toner, from the viewpoint of improving low-temperature fusing ability of the toner, and from the viewpoint of reducing an amount of fine powders of the toner.

The above-mentioned wax may be any of those having melting points within the range mentioned above, and the wax includes hydrocarbon waxes such as polypropylene wax, polyethylene wax, polypropylene polyethylene copolymer wax, microcrystalline wax, paraffin waxes, and Fischer-Tropsch wax, and oxides thereof; ester waxes such as synthetic ester waxes, carnauba wax, montan wax, sazole wax, and deacidified waxes thereof; fatty acid amides, fatty acids, higher alcohols, metal salts of aliphatic acids, and the like. These waxes may be used alone or in a mixture of two or more kinds. The wax is preferably a hydrocarbon wax, and more preferably a polypropylene wax.

The content of the α-olefin based polymer is preferably 50% by mass or more, more preferably 60% by mass or more, even more preferably 65% by mass or more, even more preferably 80% by mass or more, and even more preferably 90% by mass or more, of the releasing agent, from the viewpoint of inhibiting photoconductor filming of the toner, and from the viewpoint of improving triboelectric stability, thereby inhibiting the generation of background fogging and the lowering of solid image quality of the toner.

In addition, in a case where the above-mentioned wax is contained, from the viewpoint of inhibiting photoconductor filming of the toner, and from the viewpoint of improving triboelectric stability, thereby inhibiting the generation of background fogging and the lowering of solid image quality of the toner, the content of the wax is preferably 0.1 parts by mass or more, more preferably 0.2 parts by mass or more, and even more preferably 0.5 parts by mass or more, based on 100 parts by mass of the resin binder, and the content of the wax is preferably 5 parts by mass or less, more preferably 3 parts by mass or less, and even more preferably 2 parts by mass or less, based on 100 parts by mass of the resin binder.

A mass ratio of the α-olefin based polymer to the above-mentioned wax, i.e. the α-olefin based polymer/the wax, is preferably 50/50 or more and 95/5 or less, more preferably 60/40 or more and 95/5 or less, and even more preferably 65/35 or more and 90/10 or less, from the viewpoint of inhibiting photoconductor filming of the toner, and from the viewpoint of improving triboelectric stability, thereby inhibiting the generation of background fogging and the lowering of solid image quality of the toner.

From the viewpoint of inhibiting photoconductor filming of the toner, and from the viewpoint of improving triboelectric stability, thereby inhibiting the generation of background fogging and the lowering of solid image quality of the toner, a total amount of the α-olefin based polymer and the above-mentioned wax is preferably 0.5 parts by mass or more, more preferably 1.0 part by mass or more, even more preferably 1.5 parts by mass or more, and even more preferably 2.0 parts by mass or more, based on 100 parts by mass of the resin binder, and a total amount is preferably 15 parts by mass or less, more preferably 10 parts by mass or less, even more preferably 8 parts by mass or less, and even more preferably 5 parts by mass or less, based on 100 parts by mass of the resin binder.

[Charge Control Agent]

The charge control agent may be any of positively chargeable charge control agents and negatively chargeable charge control agents.

The positively chargeable charge control agent includes non-polymer type positively chargeable charge control agents, including Nigrosine dyes, including, for example, "BONTRON N-01," "BONTRON N-04," "BONTRON N-07," hereinabove commercially available from Orient Chemical Industries Co., Ltd., "CHUO CCA-3," commercially available from Chuo Synthetic Chemical Co., Ltd., and the like; triphenylmethane-based dyes containing a tertiary amine as a side chain; quaternary ammonium salt compounds including, for example, "BONTRON P-51" commercially available from Orient Chemical Industries Co., Ltd., "TP-415" commercially available from Hodogaya Chemical Co., Ltd., cetyltrimethylammonium bromide, "COPY CHARGE PX VP435," commercially available from Clariant Ltd., and the like; imidazole derivatives including, for example, "PLZ-2001," "PLZ-8001," hereinabove commercially available from Shikoku Chemicals Corporation, and the like; and polymer type positively chargeable charge control agents (hereinafter referred to as a positively chargeable charge control resins), including polyamine resins include, for example, "AFP-B" commercially available from Orient Chemical Industries Co., Ltd., and the like; styrene-acrylic resins including, for example, "FCA-201-PS," commercially available from FUJIKURAKASEI CO., LTD., and the like.

Among the above positively chargeable charge control agents, a Nigrosine dye is preferred, and a combined use of a Nigrosine dye with a quaternary ammonium salt compound is more preferred, from the viewpoint of improving triboelectric stability, thereby inhibiting the generation of background fogging and the lowering of solid image quality of the toner. In addition, it is even more preferable to use together with a positively chargeable charge control resin, from the viewpoint of improving triboelectric stability, thereby inhibiting the generation of background fogging and the lowering of solid image quality of the toner.

The Nigrosine dye is generally a black mixture composed of a large number of components obtained by polycondensation of nitrobenzene and aniline in the presence of a metal catalyst, and its structure is not fully elucidated. Commercially available Nigrosine dyes, including modified products with a resin acid or the like, include, besides "BONTRON N-01," "BONTRON N-04" and "BONTRON N-07" mentioned above, "Nigrosine Base EX," "Oil Black BS," "Oil Black SO," "BONTRON N-09," "BONTRON N-11," "BONTRON N-21" hereinabove commercially available from Orient Chemical Industries Co., Ltd., "Nigrosine" commercially available from Ikeda Kagaku Kogyo, "Spirit Black No. 850," "Spirit Black No. 900" hereinabove commercially available from Sumitomo Chemical Co., Ltd., and the like.

The quaternary ammonium salt compound is more preferably a quaternary ammonium salt compound represented by the formula (II):

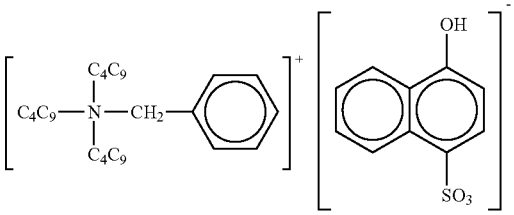

(II)

Here, a commercially available product of the quaternary ammonium salt compound represented by the formula (II) is, for example, "BONTRON P-51" mentioned above.

The content of the quaternary ammonium salt compound to be used together with the Nigrosine dye is preferably 5 parts by mass or more, and more preferably 10 parts by mass or more, based on 100 parts by mass of the Nigrosine dye, from the viewpoint of improving triboelectric stability, thereby inhibiting the generation of background fogging and the lowering of solid image quality of the toner. In addition, the content of the quaternary ammonium salt compound is preferably 50 parts by mass or less, and more preferably 25 parts by mass or less, based on 100 parts by mass of the Nigrosine dye.

The positively chargeable charge control resin includes styrene-acrylic resins, polyamine resins, phenol resins, and the like. Among them, styrene-acrylic resins are preferred, from the viewpoint of improving triboelectric stability, thereby inhibiting the generation of background fogging and the lowering of solid image quality of the toner.

The styrene-acrylic resin is preferably a quaternary ammonium salt group-containing styrene-acrylic copolymer, and more preferably a quaternary ammonium salt group-containing styrene-acrylic copolymer obtained by the polymerization of a monomer mixture containing a monomer represented by the formula (III):

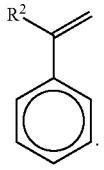

(III)

wherein $R^2$ is a hydrogen atom or a methyl group;

a monomer represented by the formula (IV):

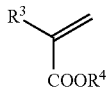

(IV)

wherein $R^3$ is a hydrogen atom or a methyl group, and $R^4$ is an alkyl group having 1 or more carbon atoms and 6 or less carbon atoms; and a monomer represented by the formula (V):

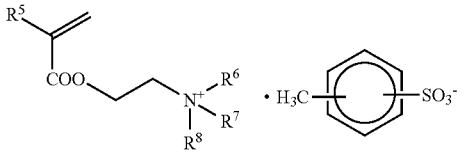

(V)

wherein $R^5$ is a hydrogen atom or a methyl group, and each of $R^6$, $R^7$, and $R^8$ is an alkyl group having 1 or more carbon atoms and 4 or less carbon atoms.

In the formula (III), $R^2$ is preferably a hydrogen atom, from the viewpoint of improving triboelectric chargeability of the toner.

In the formula (IV), it is preferable that $R^3$ is a hydrogen atom, and that $R^4$ is a butyl group, from the viewpoint of improving triboelectric chargeability of the toner.

In addition, in the formula (V), it is preferable that $R^5$ is a methyl group, and that each of $R^6$, $R^7$ and $R^8$ is an ethyl group, from the viewpoint of improving triboelectric chargeability of the toner.

From the viewpoint of improving triboelectric stability, thereby inhibiting the generation of background fogging and the lowering of solid image quality of the toner, the content of the monomer represented by the formula (III) is preferably 60% by mass or more, more preferably 70% by mass or more, and even more preferably 78% by mass or more, of the monomer mixture, and the content is preferably 95% by mass or less, and more preferably 90% by mass or less, of the monomer mixture.

From the viewpoint of improving triboelectric stability, thereby inhibiting the generation of background fogging and the lowering of solid image quality of the toner, the content of the monomer represented by the formula (IV) is preferably 2% by mass or more, more preferably 5% by mass or more, and even more preferably 10% by mass or more, of the monomer mixture, and the content is preferably 30% by mass or less, more preferably 20% by mass or less, and even more preferably 15% by mass or less, of the monomer mixture.

From the viewpoint of improving triboelectric stability, thereby inhibiting the generation of background fogging and the lowering of solid image quality of the toner, the content of the monomer represented by the formula (V) is preferably 3% by mass or more, more preferably 5% by mass or more, and even more preferably 10% by mass or more, of the monomer mixture, and the content is preferably 35% by mass or less, more preferably 30% by mass or less, and even more preferably 25% by mass or less, of the monomer mixture.

The polymerization of the monomer mixture can be carried out by, for example, heating a monomer mixture to a temperature of 50° C. or higher and 100° C. or lower in an inert gas atmosphere in the presence of a polymerization initiator such as azobisdimethylvaleronitrile. Here, the polymerization method may be any of solution polymerization, suspension polymerization, or bulk polymerization, and preferably solution polymerization.

From the viewpoint of improving triboelectric stability, thereby inhibiting the generation of background fogging and the lowering of solid image quality of the toner, the softening point of the quaternary ammonium salt group-containing styrene-acrylic copolymer is preferably 115° C. or higher, more preferably 117° C. or higher, and even more preferably 120° C. or higher, and the softening point is preferably 140° C. or lower, and more preferably 135° C. or lower.

The quaternary ammonium salt group-containing styrene-acrylic copolymer includes, for example, "FCA-201-PS," commercially available from FUJIKURAKASEI CO., LTD.

Other styrene-acrylic resins include styrene-acrylic copolymers not containing a quaternary ammonium salt group "FCA-1001NS," commercially available from FUJIKURAKASEI CO., LTD. and the like. In addition, the polyamine resin includes "AFP-B" commercially available from Orient Chemical Industries Co., Ltd., and the like, and the phenol resin includes "FCA-2521NJ," "FCA-2508N," hereinabove commercially available from FUJIKURAKASEI CO., LTD. and the like.

The negatively chargeable charge control agent includes metal-containing azo dyes, for example, "BONTRON S-28," commercially available from Orient Chemical Industries Co., Ltd., "T-77," commercially available from Hodogaya Chemical Co., Ltd., "BONTRON S-34," commercially available from Orient Chemical Industries Co., Ltd., "AIZEN SPILON BLACK TRH," commercially available from Hodogaya Chemical Co., Ltd., and the like; copper phthalocyanine dyes; metal complexes of alkyl derivatives of salicylic acid, for example, "BONTRON E-81," "BONTRON E-84," "BONTRON E-304," hereinabove commercially available from Orient Chemical Industries Co., Ltd., and the like; nitroimidazole derivatives; boron complexes of benzilic acid, for example, "LR-147," commercially available from Japan Carlit Co., Ltd., and the like; nonmetallic charge control agents, for example, "BONTRON F-21," "BONTRON E-89," hereinabove commercially available from Orient Chemical Industries Co., Ltd., "T-8," commercially available from Hodogaya Chemical Co., Ltd., and the like.

From the viewpoint of inhibiting photoconductor filming of the toner, from the viewpoint of improving triboelectric stability, thereby inhibiting the generation of background fogging and the lowering of solid image quality of the toner, the content of the charge control agent is preferably 0.3 parts by mass or more, more preferably 1 part by mass or more, and even more preferably 2 parts by mass or more, based on 100 parts by mass of the resin binder, and the content is preferably 20 parts by mass or less, more preferably 18 parts by mass or less, and even more preferably 15 parts by mass or less, based on 100 parts by mass of the resin binder.

Since the toner of the present invention contains an α-olefin based polymer and a polyester (A), share acts so as to evenly apply between the resins during melt-kneading to keep a homogeneous viscosity, so that the charge control agent homogeneously disperses in the toner. Here, since the polyester is negatively charged, in a case where a positively chargeable charge control agent is used, the share is more applied during the melt-kneading by an electrostatic interaction with the polyester, whereby resulting in improvement in dispersibility of the α-olefin based polymer. In other words, the dispersibility improving effects of the α-olefin based polymer and the positively chargeable charge control agent synergistically act thereon, whereby consequently the photoconductor filming of the toner can be inhibited, and triboelectric stability is improved, thereby inhibiting the generation of background fogging and the lowering of solid image quality of the toner. Therefore, it is preferable that the toner is used as a positively chargeable toner containing a positively chargeable charge control agent.

From the viewpoint of inhibiting photoconductor filming of the toner, and from the viewpoint of improving triboelectric stability, thereby inhibiting the generation of background fogging and the lowering of solid image quality of the toner, the content of the positively chargeable charge control agent which is not polymer type, when used as a positively chargeable toner, is preferably 0.3 parts by mass or more, more preferably 1 part by mass or more, and even more preferably 2 parts by mass or more, based on 100 parts by mass of the resin binder, and the content is preferably 20 parts by mass or less, more preferably 18 parts by mass or less, and even more preferably 15 parts by mass or less, based on 100 parts by mass of the resin binder.

From the same viewpoint, the content of the positively chargeable charge control agent which is not polymer type, when using the positively chargeable charge control agent which is not a polymer type together with a positively chargeable charge control resin, is preferably 0.3 parts by mass or more, more preferably 1 part by mass or more, even more preferably 2 parts by mass or more, and even more preferably 3 parts by mass or more, based on 100 parts by mass of the resin binder, and the content is preferably 10 parts by mass or less, more preferably 8 parts by mass or less, even more preferably 7 parts by mass or less, and even more preferably 6 parts by mass or less, based on 100 parts by mass of the resin binder. In addition, from the same viewpoint, the content of the positively chargeable charge control resin is preferably 1 part by mass or more, more preferably 2 parts by mass or more, even more preferably 3 parts by mass or more, and even more preferably 5 parts by mass or more, based on 100 parts by mass of the resin binder, and the content is preferably 18 parts by mass or less, more preferably 15 parts by mass or less, even more preferably 12 parts by mass or less, and even more preferably 10 parts by mass or less, based on 100 parts by mass of the resin binder. From the same viewpoint, a total content of the positively chargeable charge control resin which is not polymer type and the positively chargeable charge control agent is preferably 0.3 parts by mass or more, more preferably 1 part by mass or more, and even more preferably 2 parts by mass or more, based on 100 parts by mass of the resin binder, and a total content is preferably 20 parts by mass or less, more preferably 18 parts by mass or less, and even more preferably 15 parts by mass or less, based on 100 parts by mass of the resin binder.

Here, the positively chargeable toner may be used together with a negatively chargeable charge control agent within a range that would not hamper the positive triboelectric chargeability of the toner, and it is preferable that a negatively chargeable charge control agent is not contained, and if contained, the content of the negatively chargeable charge control agent is more preferably 0.5 parts by mass or less, based on 100 parts by mass of the resin binder.

The toner of the present invention may properly contain a colorant.

[Colorant]

In the present invention, as the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. As the colorant, Phthalocyanine Blue 15:3, Phthalocyanine Blue 15:4, and carbon blacks are preferred, and Phthalocyanine Blue 15:3 and carbon blacks are more preferred, from the viewpoint of improving image quality.

The content of the colorant is preferably 1 part by mass or more, more preferably 2 parts by mass or more, and even more preferably 3 parts by mass or more, based on 100 parts by mass of the resin binder, from the viewpoint of improving optical density of the toner. In addition, the content of the colorant is preferably 20 parts by mass or less, more preferably 10 parts by mass or less, and even more preferably 8 parts by mass or less, based on 100 parts by mass of the resin binder, from the viewpoint of improving productivity of the toner.

In the present invention, an additive such as a magnetic particulate, a fluidity improver, an electric conductivity modifier, a reinforcing filler such as a fibrous material, an antioxidant, an anti-aging agent, or a cleanability improver may be further properly contained as a toner material.

<Method for Producing Toner>

The toner of the present invention may be a toner obtained by any of the conventional known methods such as a melt-kneading method, an emulsion aggregation method, and a polymerization method, and a pulverized toner produced by the melt-kneading method is preferred, from the viewpoint of improving productivity. Therefore, the method for producing a toner of the present invention is preferably a method including the step of melt-kneading toner components including a resin binder containing a polyester (A), a releasing agent, and a charge control agent, to provide a melt-kneaded mixture. Specifically, the toner can be produced by homogeneously mixing toner components including a resin binder containing a polyester (A), a releasing agent, and a charge control agent, and optionally additives such as a colorant, with a mixer such as a Henschel mixer, thereafter melt-kneading the mixture, cooling, pulverizing, and classifying the product.

The melt-kneading of the toner components including a resin binder containing a polyester (A), a releasing agent, and a charge control agent, and optionally additives such as a colorant can be carried out with a known kneader, such as a closed kneader, a single-screw or twin-screw kneader, or an open-roller type kneader. From the viewpoint of lowering the temperature during melt-kneading, thereby improving low-temperature fusing ability and heat-resistant storage property of the toner, and from the viewpoint of being capable of efficiently highly dispersing the toner components such as a releasing agent and a charge control agent in the resin binder without repeats of kneading or without a dispersion aid, it is preferable to use a twin-screw kneader.

The twin-screw kneader refers to a closed-type kneader in which two kneading screws are covered with barrel, and it is preferable that the twin-screw kneader is a type of which screws can be rotated in the same direction of the screw rotations. As commercially available products, twin-screw extruders, PCM Series commercially available from IKEGAI Corporation, which allow excellent engagement of the two screws at high speeds, are preferred, from the viewpoint of improving productivity.

It is preferable that the toner components including a resin binder containing a polyester (A), a releasing agent, and a charge control agent, and optionally additives such as a colorant are previously mixed with a Henschel mixer, a ball-mill or the like, and thereafter fed to the kneader.

The melt-kneading with the twin-screw kneader is carried out by adjusting a barrel setting temperature, i.e. a temperature of an internal wall side of the extruder, peripheral speeds of the screw rotation of the twin screws, and supplying rates of raw materials. From the viewpoint of improving dispersibility of a releasing agent and a charge control agent or the like in a resin binder, and from the viewpoint of improving productivity of the toner, the barrel setting temperature is preferably 80° C. or higher, and more preferably 90° C. or higher, and the barrel setting temperature is preferably 140° C. or lower, and more preferably 120° C. or lower.

The peripheral speed of the screw rotation of the twin screws is preferably from 0.1 msec or more and 1 msec or less, from the viewpoint of improving dispersibility of a releasing agent and a charge control agent and the like in the resin binder, and from the viewpoint of improving productivity of the toner.

The feeding rates for the raw materials to the twin-screw kneader are appropriately adjusted in accordance with the allowable capacity of the kneader used and the barrel setting temperature and the peripheral speed of the shaft rotations mentioned above.

It is preferable that the resulting kneaded mixture is cooled to a pulverizable state, and thereafter pulverized and classified.

The pulverizing step may be carried out in divided multi-stages. For example, the resin kneaded product may be roughly pulverized to a size of from 1 to 5 mm or so, and the roughly pulverized product may then be further finely pulverized to a desired particle size.

The pulverizer usable in the pulverizing step is not particularly limited. For example, the pulverizer preferably usable in the rough pulverization includes a hammer-mill, an atomizer, Rotoplex, and the like, and the pulverizer preferably usable in the fine pulverization includes an impact type jet mill, a fluidised bed opposed jet mill, a rotary mechanical mill, and the like. It is preferable to use a fluidised bed opposed jet mill and an impact type jet mill, and it is more preferable to use an impact type jet mill, from the viewpoint of pulverization efficiency.

The classifier used in the classification step includes an air classifier, a rotor type classifier, a sieve classifier, and the like. The pulverized product which is insufficiently pulverized and removed during the classifying step may be subjected to the pulverization step again, and the pulverization step and the classification step may be repeated as occasion demands.

[Toner]

In the toner of the present invention, toner particles obtained after pulverizing and classifying steps of the toner, i.e. toner matrix particles, may be further subjected to an external additive treatment including depositing an external additive thereto, from the viewpoint of inhibiting photoconductor filming of the toner, and from the viewpoint of improving triboelectric stability, thereby inhibiting the generation of background fogging and the lowering of solid image quality of the toner, The external additive includes, for example, fine inorganic particles of silica, alumina, titania, zirconia, tin oxide, zinc oxide, and the like, and fine organic particles such as fine melamine resin particles and fine polytetrafluoroethylene resin particles. Among them, fine inorganic particles of silica are preferred as the inorganic particles, and polytetrafluoroethylene resin particles are preferred as the organic particles, and a hydrophobic silica that is hydrophobically treated is more preferred, from the viewpoint of improving triboelectric chargeability, fluidity, and transferability of the toner.

The number-average particle size of the external additive is preferably 5 nm or more, from the viewpoint of improving triboelectric chargeability, fluidity, and transferability of the toner, and the number-average particle size is preferably 1 μm or less, more preferably 800 nm or less, and even more preferably 600 nm or less, from the viewpoint of inhibiting photoconductor filming of the toner.

From the viewpoint of improving triboelectric chargeability, fluidity, and transferability of the toner, the number-average particle size of the inorganic particles is preferably 5 nm or more, and the number-average particle size is preferably 100 nm or less, more preferably 70 nm or less, and even more preferably 50 nm or less.

The content of the external additive is preferably 0.2 parts by mass or more, more preferably 0.5 parts by mass or more, even more preferably 0.8 parts by mass or more, and even more preferably 1 part by mass or more, based on 100 parts by mass of the toner matrix particles, from the viewpoint of improving triboelectric chargeability, fluidity, and transferability of the toner. In addition, the content of the external additive is preferably 10 parts by mass or less, more preferably 7 parts by mass or less, even more preferably 5 parts by mass or less, and even more preferably 2 parts by mass or less, based on 100 parts by mass of the toner matrix particles.

In the mixing of the toner matrix particles with an external additive, a mixer having an agitating member such as rotary blades is preferably used, more preferably a high-speed mixer such as a Henschel mixer or Super Mixer, and even more preferably a Henschel mixer.

The toner of the present invention has a volume-median particle size $D_{50}$ of preferably 3 μm or more, more preferably 4 μm or more, and even more preferably from 6 μm or more, from the viewpoint of improving the image quality of the toner. Also the toner has a volume-median particle size of preferably 15 μm or less, more preferably 12 μm or less, and even more preferably 9 μm or less. The term "volume-median particle size $D_{50}$" as used herein means a particle size of which cumulative volume frequency calculated on a volume percentage is 50% counted from the smaller particle sizes. Also, in a case where the toner is treated with an external additive, the volume-median particle size is regarded as a volume-median particle size of the toner matrix particles.

The toner of the present invention can be used as a toner directly for monocomponent development, or as a toner for use in a two-component development prepared by mixing a toner with a carrier, in an apparatus for forming fused images of a monocomponent development or a two-component development.

Regarding the embodiments mentioned above, the present invention will further disclose the toner as set forth below.

<1> A toner containing a resin binder, a releasing agent, and a charge control agent, wherein the resin binder contains a polyester (A) obtained by polycondensing a carboxylic acid component containing one or more succinic acid derivatives selected from succinic acids substituted with an alkyl group having 8 or more carbon atoms and 20 or less carbon atoms and succinic acids substituted with an alkenyl group having 8 or more carbon atoms and 20 or less carbon atoms, and an alcohol component, a content of the succinic acid derivative being 10% by mol or more and 30% by mol or less of a total amount of the raw material monomers of all the polyesters in the resin binder, and wherein the releasing agent contains an α-olefin based polymer obtained by polymerizing monomers containing an α-olefin having 26 or more carbon atoms and 28 or less carbon atoms in an amount of 95% by mol or more, a content of the α-olefin based polymer being from 0.5 parts by mass or more and 10 parts by mass or less, based on 100 parts by mass of the resin binder.

<2> The toner according to the above <1>, wherein the succinic acid substituted with an alkyl group having 8 or more carbon atoms and 20 or less carbon atoms and the succinic acid substituted with an alkenyl group having 8 or more carbon atoms and 20 or less carbon atoms are preferably dodecenylsuccinic acid and tetrapropenylsuccinic acid, and acid anhydrides thereof, and more preferably tetrapropenylsuccinic anhydride.

<3> The toner according to the above <1> or <2>, wherein the number of carbon atoms of the alkyl group or alkenyl group in the succinic acid derivative is preferably 10 or more, and more preferably 12 or more, and the number of carbon atoms is preferably 18 or less, and more preferably 16 or less.

<4> The toner according to any one of the above <1> to <3>, wherein the succinic acid derivative is preferably one or more members selected from the group consisting of succinic acids substituted with an alkyl group having 10 or more carbon atoms and 20 or less carbon atoms and the succinic acids substituted with an alkenyl group having 10 or more carbon atoms and 20 or less carbon atoms, and more preferably one or more members selected from the group consisting of succinic acids substituted with an alkyl group having 12 or more carbon atoms and 16 or less carbon atoms and the succinic acids substituted with an alkenyl group having 12 or more carbon atoms and 16 or less carbon atoms.

<5> The toner according to any one of the above <1> to <4>, wherein the content of the succinic acid derivative is preferably 3% by mol or more, more preferably 10% by mol or more, even more preferably 15% by mol or more, and even more preferably 20% by mol or more, and preferably 90% by mol or less, more preferably 88% by mol or less, even more preferably 86% by mol or less, and even more preferably 85% by mol or less, of the carboxylic acid component of the polyester (A).

<6> The toner according to any one of the above <1> to <5>, wherein The alcohol component of the polyester (A) is preferably an alkylene oxide adduct of bisphenol A represented by the formula (I), wherein the content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

<7> The toner according to any one of the above <1> to <6>, wherein the softening point of the polyester (A) is preferably 80° C. or higher, more preferably 100° C. or higher, even more preferably 110° C. or higher, and even more preferably 120° C. or higher, and preferably 170° C. or lower, more preferably 165° C. or lower, even more preferably 160° C. or lower, and even more preferably 158° C. or lower.

<8> The toner according to any one of the above <1> to <7>, wherein the glass transition temperature of the polyester (A) is preferably 30° C. or higher, more preferably 35° C. or higher, and even more preferably 38° C. or higher, and preferably 90° C. or lower, more preferably 80° C. or lower, even more preferably 70° C. or lower, and even more preferably 65° C. or lower.

<9> The toner according to any one of the above <1> to <8>, wherein the acid value of the polyester (A) is preferably 20 mgKOH/g or less, more preferably 15 mgKOH/g or less, and even more preferably 10 mgKOH/g or less.

<10> The toner according to any one of the above <1> to <9>, wherein the hydroxyl value of the polyester (A) is preferably 60 mgKOH/g or less, more preferably 50 mgKOH/g or less, and even more preferably 30 mgKOH/g or less.

<11> The toner according to any one of the above <1> to <10>, wherein the polyester (A) contains two kinds of polyester (A)s having different softening points, and wherein of the two kinds of the polyester (A)s having different softening points mentioned above, when a polyester (A) having a higher softening point is referred to as a polyester (A-H), and a polyester (A) having a lower softening point is referred to as a polyester (A-L), a difference in softening points between the polyester (A-H) and the polyester (A-L) is preferably 10° C. or more, more preferably 15° C. or more, and even more preferably 20° C. or more, and preferably 65° C. or less, more preferably 50° C. or less, and even more preferably 40° C. or less.

<12> The toner according to the above <11>, wherein the softening point of the polyester (A-H) is preferably 140° C. or higher, more preferably 145° C. or higher, and even more preferably 150° C. or higher, and preferably 170° C. or lower, more preferably 165° C. or lower, and even more preferably 160° C. or lower.

<13> The toner according to the above <11> or <12>, wherein the softening point of the polyester (A-L) is preferably 105° C. or higher, more preferably 110° C. or higher, and even more preferably 115° C. or higher, and preferably 140° C. or lower, more preferably 130° C. or lower, and even more preferably 125° C. or lower.

<14> The toner according to any one of the above <11> to <13>, wherein it is preferable that the polyester (A-H) and the polyester (A-L) have different glass transition temperatures, and wherein the glass transition temperature of the polyester (A-H) is preferably exceeding 55° C., more preferably 57° C. or higher, and even more preferably 60° C. or higher, and preferably 75° C. or lower, more preferably 70° C. or lower, and even more preferably 65° C. or lower.

<15> The toner according to the above <14>, wherein the glass transition temperature of the polyester (A-L) is preferably lower than a glass transition temperature of the polyester (A-H), and wherein a difference in the glass transition temperatures between the polyester (A-H) and the polyester (A-L) is preferably 5° C. or more, more preferably 7° C. or more, and even more preferably 9° C. or more, and preferably 40° C. or less, more preferably 30° C. or less, and even more preferably 25° C. or less.

<16> The toner according to any one of the above <11> to <15>, wherein the content of the succinic acid derivative in the polyester (A-H) is preferably 5% by mol or more, more preferably 15% by mol or more, and even more preferably 20% by mol or more, and preferably 35% by mol or less, more preferably 30% by mol or less, and even more preferably 27% by mol or less, of the carboxylic acid component of the polyester (A-H).

<17> The toner according to any one of the above <11> to <16>, wherein the content of the succinic acid derivative in the polyester (A-H) is preferably 2% by mol or more, more preferably 5% by mol or more, and even more preferably 7% by mol or more, and preferably 20% by mol or less, more preferably 17% by mol or less, and even more preferably 14% by mol or less, of a total amount of the raw material monomers of the polyester (A-H), in other words, a total amount of the carboxylic acid component and the alcohol component.

<18> The toner according to any one of the above <11> to <17>, wherein the content of the succinic acid derivative in the polyester (A-L) is preferably 15% by mol or more, more preferably 25% by mol or more, and even more preferably 30% by mol or more, and preferably 95% by mol or less, more preferably 90% by mol or less, and even more preferably 85% by mol or less, of the carboxylic acid component of the polyester (A-L).

<19> The toner according to any one of the above <11> to <18>, wherein the content of the succinic acid derivative in the polyester (A-L) is preferably 5% by mol or more, more preferably 7% by mol or more, and even more preferably 10% by mol or more, and preferably 50% by mol or less, more preferably 45% by mol or less, and even more preferably 40% by mol or less, of a total amount of the raw material monomers of the polyester (A-L), in other words, a total amount of the carboxylic acid component and the alcohol component.

<20> The toner according to any one of the above <11> to <19>, wherein a mass ratio of the polyester (A-H) to the polyester (A-L) in the resin binder, i.e. the polyester (A-H)/the polyester (A-L), is preferably 10/90 or more and 90/10 or less, more preferably 20/80 or more and 80/20 or less, even more preferably 70/30 or more and 30/70 or less, and even more preferably 60/40 or more and 40/60 or less.

<21> The toner according to any one of the above <1> to <20>, wherein the content of the polyester (A) is preferably 60% by mass or more, more preferably 70% by mass or more, even more preferably 80% by mass or more, even more preferably 90% by mass or more, and even more preferably 95% by mass or more, of the resin binder, and wherein it is even more preferable to use the polyester (A) alone as the resin binder.

<22> The toner according to any one of the above <1> to <21>, wherein the content of the succinic acid derivative in all the polyesters in the resin binder, i.e. the polyester (A) and the polyesters other than the polyester (A), is preferably 12% by mol or more, more preferably 13% by mol or more, and even more preferably 14% by mol or more, and preferably 28% by mol or less, and more preferably 25% by mol or less, of a total amount of the raw material monomers in each of the polyesters, in other words, a total amount of the carboxylic acid component and the alcohol component.

<23> The toner according to any one of the above <1> to <22>, wherein the content of the α-olefin having 26 or more carbon atoms and 28 or less carbon atoms in the raw material monomers of the α-olefin based polymer is preferably 97% by mol or more.

<24> The toner according to any one of the above <1> to <23>, wherein the melting point of the α-olefin based polymer is preferably 60° C. or higher, more preferably 64° C. or higher, even more preferably 68° C. or higher, and even more preferably 72° C. or higher, and preferably 90° C. or lower, more preferably 85° C. or lower, and even more preferably 80° C. or lower.

<25> The toner according to any one of the above <1> to <24>, wherein the melt viscosity at 100° C. of the α-olefin based polymer is preferably 100 mPa·s or more, more preferably 120 mPa·s or more, even more preferably 150 mPa·s or more, even more preferably 180 mPa·s or more, and even more preferably 190 mPa·s or more, and preferably 300 mPa·s or less, more preferably 250 mPa·s or less, and even more preferably 220 mPa·s or less.

<26> The toner according to any one of the above <1> to <25>, wherein the content of the α-olefin based polymer of the toner is preferably 1 part by mass or more, more preferably 1.5 parts by mass or more, and even more preferably 2 parts by mass or more, and preferably 8 parts by mass or less, more preferably 6 parts by mass or less, even more preferably 5 parts by mass or less, and even more preferably 4 parts by mass or less, based on 100 parts by mass of the resin binder.

<27> The toner according to any one of the above <1> to <26>, further containing a wax having a melting point different from the melting point of the α-olefin based polymer, wherein the melting point of the wax is preferably 120° C. or higher, even more preferably 130° C. or higher, and even more preferably 135° C. or higher, and preferably 160° C. or lower, and more preferably 150° C. or lower.

<28> The toner according to the above <27>, wherein the wax having a melting point different from the melting point of the α-olefin based polymer is preferably a hydrocarbon wax, and more preferably a polypropylene wax.

<29> The toner according to any one of the above <1> to <28>, wherein the charge control agent is a positively chargeable charge control agent.

<30> The toner according to the above <29>, wherein the positively chargeable charge control agent contains a Nigrosine dye.

<31> The toner according to the above <30>, wherein the positively chargeable charge control agent further contains a quaternary ammonium salt compound.

<32> The toner according to the above <31>, wherein the positively chargeable charge control agent further contains a positively chargeable charge control resin.

<33> The toner according to the above <31> or <32>, wherein the content of the quaternary ammonium salt compound to be used together with the Nigrosine dye is preferably 5 parts by mass or more, and more preferably 10 parts by mass or more, and preferably 50 parts by mass or less, and more preferably 25 parts by mass or less, based on 100 parts by mass of the Nigrosine dye.

<34> The toner according to any one of the above <1> to <33>, which is a positively chargeable toner containing a positively chargeable charge control agent.

<35> The toner according to any one of the above <29> to <34>, wherein the content of the positively chargeable charge control agent which is not polymer type, is preferably 0.3 parts by mass or more, more preferably 1 part by mass or more, and even more preferably 2 parts by mass or more, and preferably 20 parts by mass or less, more preferably 18 parts by mass or less, and even more preferably 15 parts by mass or less, based on 100 parts by mass of the resin binder.

EXAMPLES

The following examples further describe and demonstrate embodiments of the present invention. The examples are given solely for the purposes of illustration and are not to be construed as limitations of the present invention.

Softening Point of Resin and Toner

The softening point refers to a temperature at which half of the sample flows out, when plotting a downward movement of a plunger of a flow tester "CFT-500D", commercially available from Shimadzu Corporation, against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

Glass Transition Temperature of Resin and Toner

The glass transition temperature refers to a temperature of an intersection of the extension of the baseline of equal to or lower than the temperature of the maximum endothermic peak and the tangential line showing the maximum inclination between the kick-off of the peak and the top of the peak, wherein the endothermic peaks are measured by heating a 0.01 to 0.02 g sample weighed out in an aluminum pan to 200° C., cooling the sample from that temperature to 0° C. at a cooling rate of 10° C./min, and thereafter raising the temperature of the sample at a heating rate of 10° C./min, using a differential scanning calorimeter "DSC 210," commercially available from Seiko Instruments Inc.

Acid Value of Resin

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

Hydroxyl Value of Resin

The hydroxyl value is determined by a method according to JIS K0070.

Melting Point of Releasing Agent

Measurements are taken using a differential scanning calorimeter "DSC 210," commercially available from Seiko Instruments Inc., by weighing out a 0.01 to 0.02 g sample in an aluminum pan, heating the sample to 200° C., and cooling the sample from that temperature to 0° C. at a cooling rate of 10° C./min. Next, the measurements are taken while heating the sample at a rate of 10° C./min to 180° C. A highest temperature of endothermic peak observed in the melting endothermic curve in the above measurements obtained is defined as a melting point of a releasing agent.

Melt Viscosity of Releasing Agent

The measurements are taken in accordance with a Brookfield method using B-type viscometer LVT commercially available from Nippon ST Johnson, and the samples to be measured are heated and measured at 100° C., a temperature equal to or higher than a melting temperature of a releasing agent.

Number-Average Particle Size of External Additive

Particle sizes are determined for 500 particles from a photograph taken with a scanning electron microscope (SEM), an average of length and breadth of the particles of which is taken, and the average is referred to as a number-average particle size.

Volume-Median Particle Size of Toner

Measuring Apparatus: Coulter Multisizer II, commercially available from

Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6, is dissolved in the above electrolytic solution so as to have a concentration of 5% by mass to provide a dispersion.

Dispersion Conditions Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

Production Example 1 of Resins—Resins A to D

A 10-liter four-neck flask equipped with a nitrogen inlet tube, a dehydration tube, a stirrer, and a thermocouple was charged with raw material monomers other than tetrapropenylsuccinic anhydride and trimellitic anhydride and 20 g of an esterification catalyst tin(II) 2-ethylhexanoate, as listed in Table 1. In a nitrogen atmosphere, the contents were heated to 235° C. and reacted thereat for 5 hours, and thereafter reacted at 8.3 kPa for 1 hour. Next, the temperature was lowered to 220° C., and a normal pressure was recovered, and tetrapropenylsuccinic anhydride and trimellitic anhydride were then supplied to the reaction mixture, and the contents were reacted at 240° C. and an ambient pressure for 1 hour, and thereafter reacted at 8.3 kPa until a desired softening point was reached, to provide each of the polyesters. The physical properties of the resulting polyesters are shown in Table 1.

Production Example 2 of Resin—Resin E

A 10-liter four-neck flask equipped with a nitrogen inlet tube, a dehydration tube, a stirrer, and a thermocouple was charged with raw material monomers other than trimellitic anhydride and 20 g of an esterification catalyst tin(II) 2-ethylhexanoate, as listed in Table 1. In a nitrogen atmosphere, the contents were heated to 235° C. and reacted thereat for 5 hours, and thereafter reacted at 8.3 kPa for 1 hour. Next, the temperature was lowered to 220° C., and a normal pressure was recovered, and trimellitic anhydride was then supplied to the reaction mixture, and the contents were reacted at 235° C. and an ambient pressure for 1 hour, and thereafter reacted at 8.3 kPa until a desired softening point was reached, to provide a polyester. The physical properties of the resulting polyester are shown in Table 1.

TABLE 1

| | | Resin A | Resin B | Resin C | Resin D | Resin E |
|---|---|---|---|---|---|---|
| Raw Material Monomers | BPA-PO[1)] | 1,801 g (75) | 1,801 g (75) | 1,801 g (75) | 1,801 g (75) | 2,573 g (100) |
| | BPA-EO[2)] | 718 g (25) | 718 g (25) | 718 g (25) | 718 g (25) | — |
| | Tetrapropenylsuccinic Anhydride | 749 g (38) | 1,379 g (70) | 433 g (22) | 98 g (5) | — |
| | Terephthalic Acid | 390 g (32) | — | 586 g (48) | 732 g (60) | 830 g (68) |
| | Trimellitic Anhydride | 198 g (14) | 198 g (14) | 226 g (16) | 226 g (16) | 198 g (14) |
| Content of Succinic Acid Derivative (% by mol) in the Raw Material Monomers | | | | | | |
| in Carboxylic Acid Component | | 45.2 | 83.3 | 25.6 | 6.2 | 0 |
| in Raw Material Monomers | | 20.6 | 38.0 | 11.8 | 2.8 | 0 |
| Physical Properties of Resin | Softening Point, ° C. | 123 | 124 | 157 | 151 | 162 |
| | Glass Transition Temp., ° C. | 49 | 40 | 61 | 66 | 73 |
| | Acid Value, mgKOH/g | 6 | 6 | 9 | 5 | 4 |
| | Hydroxyl Value, mgKOH/g | 34 | 25 | 20 | 40 | 40 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane
[2)]BPA-EO: Polyoxyethylene(2.2)-2,2-bis(4-hydroxyphenyl)propane Production Example 1 of α-Olefin Based Polymer—Releasing Agent 1

"LINEALENE 26+" commercially available from Idemitsu Kosan Co., Ltd., a blend of α-olefins mainly composed of those having 26 or more carbon atoms, was distilled at a reduced pressure of 0.1 kPa, to provide a monomer A, a distillation fraction at a distillation temperature of from 200° to 300° C. This distillation fraction had a compositional ratio as follows: C (number of carbon atoms, hereinafter referred to the same) 24: 1% by mol, C26: 59% by mol, C28: 38% by mol, C30: 2% by mol.

Next, the monomer A and toluene were subjected to a dehydration treatment in an nitrogen atmosphere with dry nitrogen and active alumina, and a homogeneous supernatant solution was then extracted at room temperature of 25° C., to provide a toluene solution of the monomer A (concentration: 23% by mass).

A 200 ml Schlenk flask previously heated and dried was charged with 50 ml of the obtained toluene solution of the monomer A. Thereto were added 0.5 mmol of triisobutylaluminum, 2 μmol of (1,2'-dimethylsilylene)(2,1'-dimethylsilylene)bis(3-trimethylsilylmethylindenyl)zirconium dichloride and 8 μmol of dimethylanilinium tetrakis (pentafluorophenyl)borate, hydrogen was introduced at 85° C. in an amount so as to have a pressure of 0.15 MPa, and the components were polymerized for 60 minutes. After the termination of the polymerization reaction, the precipitated reaction product was separated at room temperature of 25° C., and the precipitates were washed with toluene and acetone, and thereafter subjected to a drying treatment under heating and a reduced pressure, to provide an α-olefin copolymer, a releasing agent 1. The resulting releasing agent 1 had a melting point of 76° C., and a melt viscosity at 100° C. of 200 mPa·s.

Production Example 2 of α-Olefin Based Polymer—Releasing Agent 2

"LINEALENE 26+" was distilled at a reduced pressure of 0.1 kPa, to provide a monomer B, a distillation fraction at a distillation temperature of from 190° to 250° C. This distillation fraction had a compositional ratio as follows: C24: 32% by mol, C26: 43% by mol, C28: 18% by mol, C30: 7% by mol.

Next, the monomer B and toluene were subjected to a dehydration treatment in an nitrogen atmosphere with dry nitrogen and active alumina, and a homogeneous supernatant solution was extracted at room temperature of 25° C., to provide a toluene solution of the monomer B (concentration: 23% by mass).

A 200 ml Schlenk flask previously heated and dried was charged with 50 ml of the obtained toluene solution of the monomer B. Thereto were added 0.5 mmol of triisobutylaluminum, 2 μmol of (1,2'-dimethylsilylene)(2,1'-dimethylsilylene)bis(3-trimethylsilylmethylindenyl)zirconium dichloride and 8 μmol of dimethylanilinium tetrakis (pentafluorophenyl)borate, and the components were polymerized at room temperature for 180 minutes. After the termination of the polymerization reaction, the precipitated reaction product was separated at room temperature of 25° C., and the precipitates were washed with toluene and acetone, and thereafter subjected to a drying treatment under heating and a reduced pressure, to provide an α-olefin copolymer, a releasing agent 2. The resulting releasing agent 2 had a melting point of 65° C., and a melt viscosity at 100° C. of 180 mPa·s.

Production Example 3 of α-Olefin Based Polymer—Releasing Agent 3

"LINEALENE 2024" commercially available from Idemitsu Kosan Co., Ltd., a blend of α-olefins mainly composed of those having 18 or more carbon atoms and 26 or less carbon atoms, was distilled at a reduced pressure of from 0.27 to 2.00 kPa, to provide a monomer C, a distillation fraction at a distillation temperature of from 180° to 220° C. This distillate had a compositional ratio as follows: C20:1% by mol, C22: 67% by mol, C24: 31% by mol, C26: 1% by mol.

The amount 2.8 kg of the resulting monomer C and 4-liter of heptane were placed in a ten-liter autoclave previously heated and dried, and the contents were heated to a copolymerizable temperature of 60° C. Thereafter, 5 mmol of triisobutylaluminum, 20 μmol of (1,2'-dimethylsilylene)(2,1'-dimethylsilylene)bis(3-trimethylsilylmethylindenyl) zirconium dichloride and 40 μmol of dimethylanilinium tetrakispentafluorophenylborate were added thereto, hydrogen was introduced in an amount so as to have a pressure of 0.1 MPa, and the components were copolymerized for 8 hours. After the termination of the copolymerization reaction, the reaction product was precipitated with acetone at room temperature of 25° C. to separate, and the precipitates were subjected to a drying treatment under heating and a reduced pressure, to provide an α-olefin copolymer, a releasing agent 3. The resulting releasing agent 3 had a melting point of 62° C., and a melt viscosity at 100° C. of 130 mPa·s.

TABLE 2

| | α-Olefin Monomer | Composition of α-Olefin Monomer: Distillates *, % by mol | | | | | | | Physical Property Values of α-Olefin Polymer: Melting Point, ° C. | Melt Viscosity at 100° C. |
|---|---|---|---|---|---|---|---|---|---|---|
| | | C18 | C20 | C22 | C24 | C26 | C28 | C30 | | |
| Releasing Agent 1 | LINEALENE 26+ | — | — | — | 1 | 59 | 38 | 2 | 76 | 200 mPa · s |
| Releasing Agent 2 | LINEALENE 26+ | — | — | — | 32 | 43 | 18 | 7 | 65 | 180 mPa · s |
| Releasing Agent 3 | LINEALENE 2024 | — | 1 | 67 | 31 | 1 | — | — | 62 | 130 mPa · s |

* Measured in accordance with gas chromatography

Examples 1 to 6 and Comparative Examples 1 to 3

Resin binders and a releasing agent as listed in Table 3, 0.6 parts by mass of a positively chargeable charge control agent "BONTRON P-51" commercially available from Orient Chemical Industries Co., Ltd., 4.0 parts by mass of a positively chargeable charge control agent "BONTRON N-04" commercially available from Orient Chemical Industries Co., Ltd., 7.0 parts by mass of a positively chargeable charge control resin "FCA-201-PS" commercially available from FUJIKURAKASEI CO., LTD., and 6.0 parts by mass of a carbon black "REGAL 330R" commercially available from Cabot Specialty Chemicals, Inc. were mixed while stirring with a Henschel mixer for one minute, and the mixture was then melt-kneaded under the conditions given hereinbelow.

The melt-kneading was carried out with a co-rotating twin-screw extruder PCM-30, commercially available from IKEGAI Corporation. The operating conditions were such that the barrel setting temperature was 100° C., a rotational speed of the screw was 200 r/min, a peripheral speed was 0.30 m/sec, and a mixture supplying rate was 10 kg/hr, to provide a resin kneaded mixture.

The resulting resin melt-kneaded mixture was cooled, and the resin melt-kneaded mixture was then pulverized and classified with an IDS pulverizer-classifier commercially available from Nippon Pneumatic Mfg. Co., Ltd., so as to have a volume-median particle size $D_{50}$ of 8.0 μm, to provide toner matrix particles.

One hundred parts by mass of the toner matrix particles obtained were mixed with 1.0 part by mass of a hydrophobic silica "R-972," commercially available from Nippon Aerosil Co., Ltd., number-average particle size: 16 nm, and 0.35 part by mass of a hydrophobic silica "TG-820F," commercially available from Cabot Specialty Chemicals Inc., number-average particle size: 8 nm as external additives, with a Henschel mixer for 3 minutes, to provide each of the toners.

Test Example 1

Triboelectric Charges

Each of the toners was loaded in a printer "HL-2040" equipped with a cleaner-less development system, commercially available from Brother Industries, Ltd., and one sheet containing an entirely solid image of A4 size (210 mm×297 mm) was printed. Thereafter, toners on the developer roller were aspirated at 10 locations with a Q/m analyzer "MODEL 210HS" commercially available from TREK, INC. and electric charges and unit mass of the toner were measured to calculate triboelectric charges (μC/g). The results are shown in Table 3.

Test Example 2

Background Fogging

Each of the toners was loaded in a printer "HL-2040" equipped with a cleaner-less development system, commercially available from Brother Industries, Ltd., and an image having a print coverage of 1% was printed for 5,000 sheets under the conditions of intermittently 20 seconds per page. A blank solid image was printed out every 1,000 sheets, and a power source was turned off in during the course of printing. The toners on the photoconductor surface were adhered to a mending tape, and coloration density was measured with an image densitometer "SPM-50" commercially available from Gretag. A difference with a coloration density before the toner adhesion was obtained, and an average of five found values from 1,000th sheets to 5,000th sheets was obtained. The results are shown in Table 3. The smaller the value, the background fogging is more inhibited.

Test Example 3

Solid Image Quality

Each of the toners was loaded in a printer "HL-2040" equipped with a cleaner-less development system, commercially available from Brother Industries, Ltd., and an image having a print coverage of 1% was printed under the conditions of intermittently 20 seconds per page. Solid image was printed every 1,000 sheets of printing, and the resulting images were visually observed. If a lower end of the image, the side coming out of the printer last, contained some defective portions, the printing was terminated, and the number of sheets of 1,000 sheets before this point was used as an index for solid image quality. The results are shown in Table 3. The larger the value, the better maintained the solid image quality.

Test Example 4

Photoconductor Filming

Ten thousand sheets were printed out in the same manner as in Test Example 3. The image of the printout of the 10,000th sheet was visually examined, to confirm the printing condition. In addition, a photoconductor unit was taken out of the printer, and the presence or absence of the photoconductor filming was visually confirmed, and evaluated in accordance with the following evaluation criteria. The results are shown in Table 3.

(Evaluation Criteria)

A: There are no problems in the printout, and filming on the photoconductor is not generated.

B: There are no problems in the printout, but the generation in filming of the photoconductor is found.

C: Filming on the photoconductor is generated, some disadvantages such as defective portions in the printout are found.

TABLE 3

| | Resin Binder, Parts by Mass | | | | | Content of | | | | | | | | |
|---|---|---|---|---|---|---|---|---|---|---|---|---|---|---|
| | Low-Softening Point Resin | | High-Softening Point Resin | | | Succinic | Releasing Agent | | | | Evaluation of Toner | | | |
| | Resin A | Resin B | Resin C | Resin D | Resin E | Acid, % by mol in Polyester | Kind | Parts by Mass | Kind | Parts by Mass | Triboelectric Charges (μC/g) | Background Fogging | Solid Image Quality | Photoconductor Filming |
| Ex. 1 | 45 | — | 55 | — | — | 15.8 | Releasing Agent 1 | 2 | — | — | 41.1 | 0.04 | 14,000 | A |
| Ex. 2 | 45 | — | — | 55 | — | 10.8 | Releasing Agent 1 | 2 | — | — | 36.5 | 0.07 | 12,000 | A |
| Ex. 3 | — | 45 | 55 | — | — | 23.6 | Releasing Agent 1 | 2 | — | — | 42.8 | 0.03 | 15,000 | A |
| Ex. 4 | 45 | — | 55 | — | — | 15.8 | Releasing Agent 1 | 1 | — | — | 38.8 | 0.05 | 12,000 | A |
| Ex. 5 | 45 | — | 55 | — | — | 15.8 | Releasing Agent 1 | 4 | — | — | 39.0 | 0.05 | 12,000 | A |
| Ex. 6 | 45 | — | 55 | — | — | 15.8 | Releasing Agent 1 | 2 | Releasing Agent 4[2)] | 1 | 40.5 | 0.04 | 14,000 | A |
| Comp. Ex. 1 | 45 | — | — | — | 55 | 9.3 | Releasing Agent 1 | 2 | — | — | 28.2 | 0.14 | 5,000 | C |
| Comp. Ex. 2 | 45 | — | 55 | — | — | 15.8 | Releasing Agent 2 | 2 | — | — | 26.1 | 0.22 | 2,000 | D |
| Comp. Ex. 3 | 45 | — | 55 | — | — | 15.8 | Releasing Agent 3 | 2 | — | — | 21.4 | 0.34 | 500 | D |

1) Weighted average of the content of the succinic acid derivatives in the polyester used. Calculation Method in the case of Ex. 1: 20.6(Resin A) × 0.45 + 11.8(Resin C) × 0.55 = 15.8

2)Releasing Agent 4: Mitsui Hi-wax NP055, commercially available from MITSUI CHEMICALS, INC., polypropylene wax, melting point: 145° C., melt viscosity at 180° C.: 50 mPa · s)

It can be seen from the above results that the toners of Examples 1 to 6 have excellent inhibition of photoconductor filming, as compared to Comparative Examples 1 to 3. Further, it can be seen that the toners of Examples 1 to 6 have excellent triboelectric stability, thereby inhibiting the generation of background fogging and the lowering of solid image quality of the toner.

The toner of the present invention is usable in developing latent images formed in, for example, an electrophotographic method, an electrostatic recording method, an electrostatic printing method, or the like.

What is claimed is:

1. A toner, comprising:

a resin binder, a releasing agent, and a charge control agent, wherein the resin binder comprises a polyester (A) obtained by polycondensing a carboxylic acid component comprising one or more succinic acid derivatives selected from the group consisting of succinic acids substituted with an alkyl group having 8 or more carbon atoms and 20 or less carbon atoms and succinic acids substituted with an alkenyl group having 8 or more carbon atoms and 20 or less carbon atoms, and an alcohol component, a content of the succinic acid derivative is 10% by mol or more and 30% by mol or less of a total amount of the raw material monomers of all the polyesters in the resin binder, and wherein the releasing agent comprises an α-olefin based polymer obtained by polymerizing monomers comprising an α-olefin having 26 or more carbon atoms and 28 or less carbon atoms in an amount of 95% by mol or more, and a content of the α-olefin based polymer is 0.5 parts by mass or more and 10 parts by mass or less, based on 100 parts by mass of the resin binder.

2. The toner according to claim 1, wherein the charge control agent is a positively chargeable charge control agent.

3. The toner according to claim 2, wherein the positively chargeable charge control agent comprises a Nigrosine dye.

4. The toner according to claim 3, wherein the positively chargeable charge control agent further comprises a quaternary ammonium salt compound.

5. The toner according to claim 1, wherein the content of the polyester (A) is 90% by mass or more of the resin binder.

6. The toner according to claim 1, wherein the releasing agent further comprises a hydrocarbon-based wax having a melting point of 120° C. or higher and 160° C. or lower.

7. The toner according to claim 1, wherein the content of the succinic acid derivative is 3% by mol or more and 90% by mol or less of the carboxylic acid component of the polyester (A).

8. The toner according to claim 1, wherein the alcohol component of the polyester (A) comprises an alkylene oxide adduct of bisphenol A represented by the formula (I):

(I)

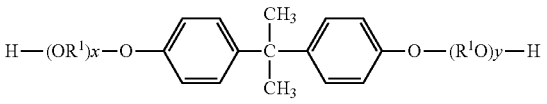

in an amount of 50% by mol or more of the alcohol component, wherein $R^1O$ and $OR^1$ are an oxyalkylene group, wherein $R^1$ is an ethylene and/or propylene group, x and y are each independently an average number of moles of the alkylene oxide added, each being a positive number, and a sum of x and y on average is 1 or more and 16 or less.

9. The toner according to claim 1, wherein the softening point of the polyester (A) is 80° C. or higher and 170° C. or lower.

10. The toner according to claim 1, wherein the polyester (A) comprises two kinds of polyester (A)s having different softening points.

11. The toner according to claim 10, wherein of the two kinds of the polyester (A)s, a difference in softening points between a high-softening point polyester (A-H) and a low-softening point polyester (A-L) is 10° C. or more.

12. The toner according to claim 11, wherein the content of the succinic acid derivative in the polyester (A-H) is 2% by mol or more and 20% by mol or less of a total amount of the raw material monomers of the polyester (A-H).

13. The toner according to claim 11, wherein the softening point of the polyester (A-H) is 140° C. or higher and 170° C. or lower.

14. The toner according to claim 11, wherein the content of the succinic acid derivative in the polyester (A-H) is 5% by mol or more and 35% by mol or less of the carboxylic acid component of the polyester (A-H).

15. The toner according to claim 11, wherein the content of the succinic acid derivative in the polyester (A-L) is 5% by mol or more and 50% by mol or less of a total amount of the raw material monomers of the polyester (A-L).

16. The toner according to claim 11, wherein a mass ratio of the polyester (A-H) to the polyester (A-L) in the resin binder is 10/90 or more and 90/10 or less, wherein the mass ratio is the polyester (A-H)/the polyester (A-L).

17. The toner according to claim 11, wherein the glass transition temperature of the polyester (A-L) is lower than the glass transition temperature of the polyester (A-H), and the difference is 5° C. or more and 40° C. or less.

18. The toner according to claim 1, wherein the melting point of the α-olefin based polymer is 60° C. or higher and 90° C. or lower.

19. A method for producing a toner as defined in claim 1, comprising melt-kneading toner components comprising a resin binder comprising a polyester (A), a releasing agent, and a charge control agent to provide a melt-kneaded mixture.

20. A toner, comprising;

a resin binder, a releasing agent, and a charge control agent, wherein the resin binder comprises a polyester (A) obtained by polycondensing a carboxylic acid component comprising one or more succinic acid derivatives selected from the group consisting of succinic acids substituted with an alkyl group having 12 or more carbon atoms and 16 or less carbon atoms and succinic acids substituted with an alkenyl group having 12 or more carbon atoms and 16 or less carbon atoms, and an alcohol component, the polyester (A) is 90% by mass or more of the resin binder, a content of the succinic acid derivative is 14% by mol or more and 25% by mol or less of a total amount of the raw material monomers of all the polyesters in the resin binder, and wherein the releasing agent comprises an α-olefin based polymer obtained by polymerizing monomers comprising an α-olefin having 26 or more carbon atoms and 28 or less carbon atoms in an amount of 95% by mol or more, a content of the α-olefin based polymer being is 2 parts by mass or more and 4 parts by mass or less, based on 100 parts by mass of the resin binder, and wherein the charge control agent is a positively chargeable charge control agent.

* * * * *